US006213742B1

(12) United States Patent
Goto et al.

(10) Patent No.: US 6,213,742 B1
(45) Date of Patent: Apr. 10, 2001

(54) SCROLL-TYPE FLUID MOVER HAVING AN ECCENTRIC SHAFT RADIALLY ALIGNED WITH A VOLUTE PORTION

(75) Inventors: Kunifumi Goto; Nobuaki Hoshino; Kiyoshi Uetsuji, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/153,374

(22) Filed: Sep. 15, 1998

(30) Foreign Application Priority Data

Sep. 16, 1997 (JP) ..... 9-250782

(51) Int. Cl.[7] ..... F01C 1/04
(52) U.S. Cl. ..... 418/55.2
(58) Field of Search ..... 418/55.1, 55.2

(56) References Cited

U.S. PATENT DOCUMENTS 4,466,784 * 8/1984 Hiraga ..... 418/55.2
5,098,265 * 3/1992 Machida et al. ..... 418/55.2
5,336,068 * 8/1994 Sekiya et al. ..... 418/55.2

FOREIGN PATENT DOCUMENTS 63-59032 11/1988 (JP) .
1-106988 * 4/1989 (JP) ..... 418/55.2
2-277985 * 11/1990 (JP) ..... 418/55.2
2-277988 * 11/1990 (JP) ..... 418/55.1
WO 96/20345 7/1996 (WO) .

* cited by examiner

*Primary Examiner*—John J. Vrablik
(74) *Attorney, Agent, or Firm*—Morgan & Finnegan, L.L.P.

(57) ABSTRACT

A scroll-type vacuum pump includes a fixed scroll and a movable scroll. The fixed scroll has a base plate and a volute portion formed on the base plate. The movable scroll includes a base plate having a volute portion. The volute portions cooperate to form a variable displacement fluid pocket between the two scrolls. The movable scroll includes a rear boss projecting from the rear surface of the base plate and a front boss projecting from the front surface of the base plate. The rear boss is located in a working region, which includes the volute portion of the movable scroll. An eccentric shaft is integrally formed on a drive shaft. The eccentric shaft is inserted in rotates relatively to both bosses to support the movable scroll. The eccentric shaft receives a radial force generated in the working region mainly through the rear boss. Accordingly, no inclination moment is applied to the movable scroll and the movable scroll does not incline with respect to the fixed scroll. This improves the performance and efficiency of the pump.

9 Claims, 4 Drawing Sheets

SCROLL-TYPE FLUID MOVER HAVING AN ECCENTRIC SHAFT RADIALLY ALIGNED WITH A VOLUTE PORTION

BACKGROUND OF THE INVENTION

The present invention relates to scroll-type fluid mover such as scroll-type vacuum pumps and compressors.

Scroll-type fluid mover, for example, scroll-type compressors have a movable scroll and a fixed scroll. Each scroll includes a base plate and a volute portion formed on the base plate. The volute portions cooperate to form a compression chamber. An eccentric shaft is formed on a drive shaft. The movable scroll is rotatably supported by the eccentric shaft. When the drive shaft rotates, the movable scroll orbits the axis of the drive shaft. Then, the compression chamber contracts from the periphery to the center of the volute portions, which compresses gas.

FIG. 6 shows a prior art structure for supporting a movable scroll with respect to the drive shaft. The structure of FIG. 6 is described as being prior art in Japanese Examined Publication No. 63-59032. In the apparatus of FIG. 6, an eccentric shaft 41 is formed on the drive shaft 42. The axis of the eccentric shaft 42 is displaced with respect to the axis of the drive shaft 42 in the radial direction by a distance equal to the revolution radius of a movable scroll 44. The drive shaft 42 is supported by a housing 48 of the compressor and a bearing 46. The movable scroll 44 includes a base plate 44*a*, a volute portion 44*b* projecting from the base plate 44*a*, a boss 43 formed on the opposite side of the base plate 44*a* from the volute portion 44*b*. The volute portion 44*b* cooperates with a volute portion 45*b* of a fixed scroll 45, which forms a compression chamber 47 between the scrolls 44, 45. The eccentric shaft 41 is inserted in the boss 43 and supports the movable scroll 44 through the boss 43. Accordingly, the eccentric shaft 41 supports the movable scroll 44 at a position outside of a working region R, which includes the volute portion 44*b*. In other words, the movable scroll 44 is supported at a position that is axially spaced from the compression chamber 47.

Centrifugal force is applied to the movable scroll 44 when it revolves. Also, compression reaction force generated by compressing gas in the compression chamber 47 is applied to the movable scroll 44. A resultant radial working force K, which combines the centrifugal force and the compression reaction force, is especially high in the working region R. However, the eccentric shaft 41 supports the movable scroll 44 at a position axially spaced from the region R. For this reason, the working force K applies an inclination moment to the movable scroll 44 with the supporting position of the eccentric shaft 41 at the center. For example, when there is a measurement error between the eccentric shaft 41 and the boss or between the volute portions 44*b*, 45*b*, the inclination moment inclines the movable scroll 44 with respect to the fixed scroll 45. Thus parts of the movable scroll 44 apply concentrated, localized forces to the fixed scroll 45. As a result, the smooth orbital movement of the movable scroll 44 is interrupted and the sealing of the compression chamber 47 between the scrolls 44, 45 deteriorates, thus causing rattling and gas leakage from the compression chamber 47.

To solve this problem, Japanese Examined Publication No. 63-59032 reveals the construction shown in FIG. 7. A movable scroll 44 has a boss 43 projecting on both sides of a base plate 44*a*. An eccentric shaft 41, which passes through the boss 43, is provided in the middle of a drive shaft 42. Accordingly, the eccentric shaft 41 supports the movable shaft 44 in a working region R, which includes the volute portion 44*b*. The drive shaft 42 has a first portion 42*a* and a second portion 42*b*, which are at opposite ends of the eccentric shaft 41. The first portion 42*a* is supported by bearings 46 and a compressor housing 48. The second portion 42*b* is supported by bearings 46 and a fixed scroll 45. Accordingly, the drive shaft 42 supports the movable scroll 44 at both sides of the working region R, or both sides of the compression chamber.

When a radial working force K based on centrifugal force and compression reaction force is applied to the movable scroll 44, the force K is received by the portions 42*a*, 42*b* of the drive shaft 42, which are located at both ends of the eccentric shaft 41. As a result, there is no inclination moment applied to the movable scroll 44, and the movable scroll 44 does not incline with respect to the fixed scroll 45.

To achieve smooth rotation of the drive shaft 42, the axes of the portions 42*a*, 42*b* of the drive shaft 42 must be precisely aligned and the axes of the bearings 46 must be precisely aligned. However, this increases the cost of production.

To insert the eccentric shaft 41, which is in the middle of the drive shaft 42, in the boss 43, at least one of the portions 42*a*, 42*b* of the drive shaft 42 must be separate from the eccentric shaft 41. After the eccentric shaft 41 is inserted in the boss 43, the separate part is fixed to the eccentric shaft 41. However, in this procedure, the number of parts and steps increase and the assembly work is difficult, thus increasing the manufacturing costs.

SUMMARY OF THE INVENTION

The present invention is designed to solve the above problems. The objective of the present invention is to provide scroll-type fluid mover that prevents the movable scroll from inclining with respect to the fixed scroll and that is easily machined due to a simple construction.

To achieve the above objective, the scroll-type fluid mover according to the present invention includes a fixed scroll, which includes a base plate and a volute portion extending from the base plate, and a movable scroll, which includes a base plate and a volute portion extending from the base plate. The two volute portions cooperate to form a variable displacement fluid pocket between the two scrolls. A drive shaft is driven to rotate about its axis. An eccentric shaft is connected to the drive shaft. The axis of the eccentric shaft is offset from the axis of the drive shaft. The eccentric shaft has a proximal end and a distal end. The proximal end is fixed to the drive shaft and the distal end is radially unsupported. The eccentric shaft rotatably supports the movable scroll so that the movable scroll orbits the axis of the drive shaft without rotating about its own axis when the drive shaft rotates. Gas is introduced into and compressed in the fluid pocket in accordance with the orbital movement of the movable scroll. The eccentric shaft extends axially such that at least a part of the eccentric shaft is located in a location that is radially aligned with the volute portion of the movable scroll, whereby the eccentric shaft supports the movable scroll to prevent inclination of the movable scroll with respect to the fixed scroll.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A scroll-type vacuum pump according to a first embodiment of the present invention will now be explained in reference to FIGS. 1 to 3.

Figure 1:
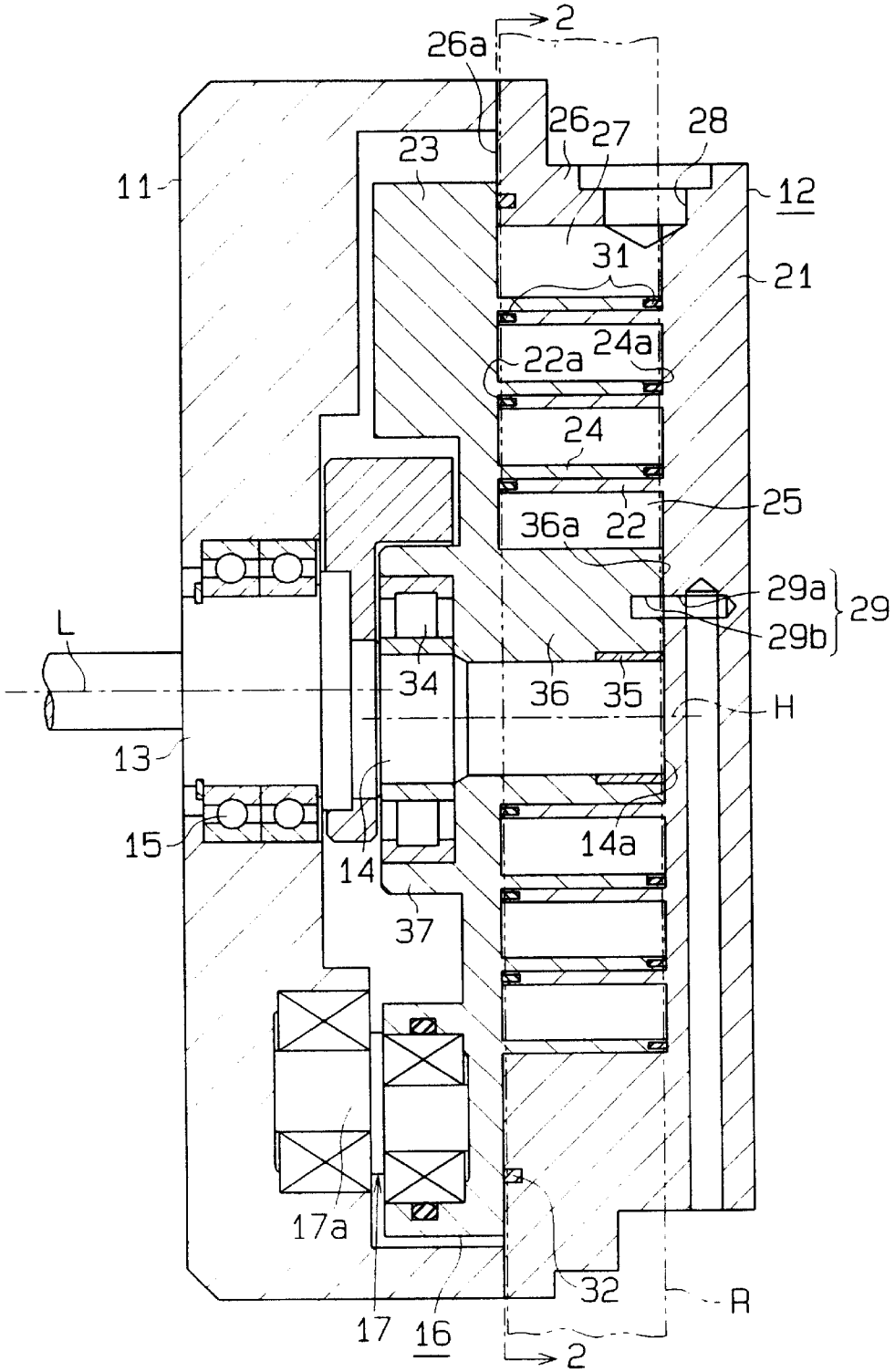
FIG. 1 is a diagrammatic cross sectional view showing a scroll-type vacuum pump of a first embodiment according to the present invention.
Figure 2:
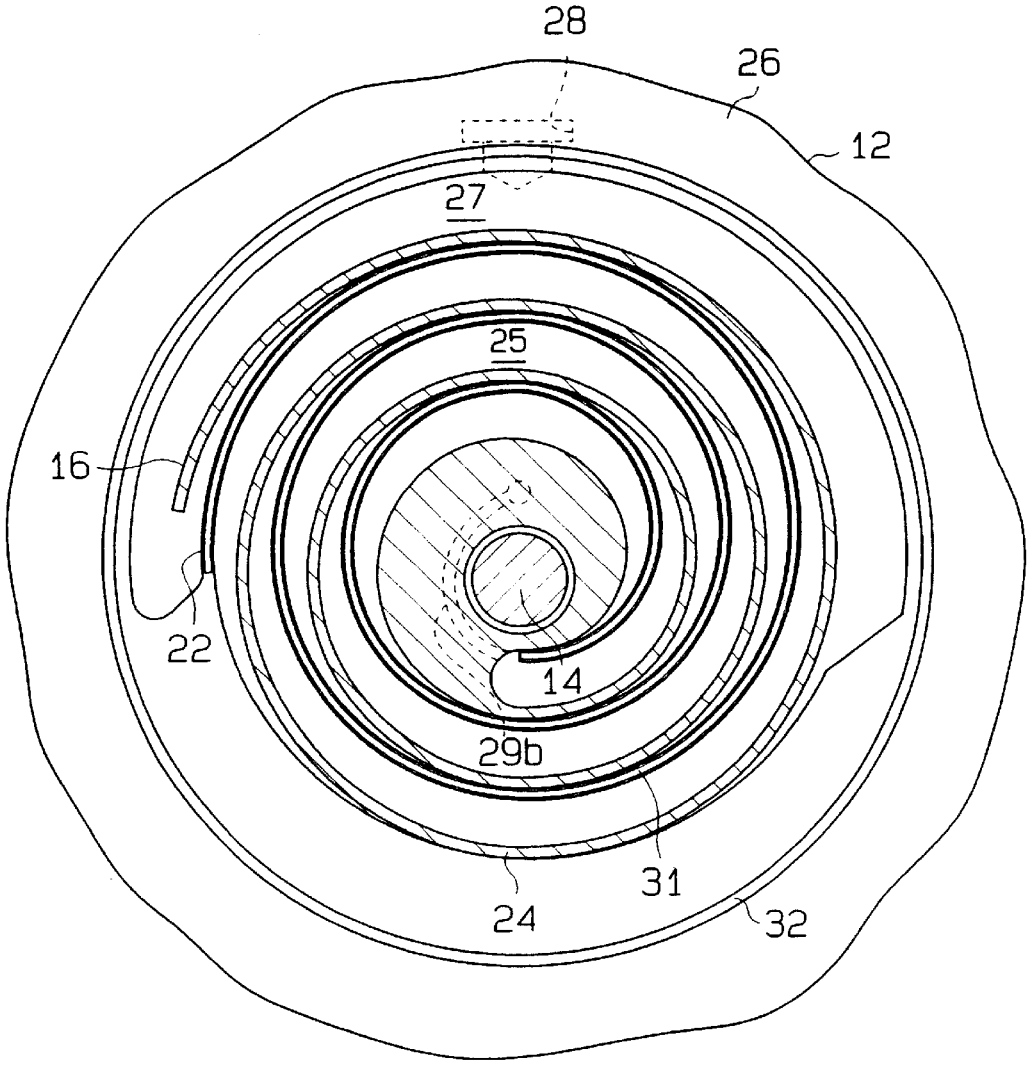
FIG. 2 is a partial sectional view taken on the line 2—2 of FIG. 1.

As shown in FIG. 1 and FIG. 2, a front housing 11 is joined to a fixed scroll 12, which also serves as a rear housing. A drive shaft 13 is rotatably supported in the front housing 11 through a bearing 15. An eccentric shaft 14 is integrally formed on one end of the drive shaft 13 in a space between the front housing 11 and the fixed scroll 12. The axis H of the eccentric shaft H is radially displaced with respect to the axis L of the drive shaft 13. The drive shaft 13 and the eccentric shaft 14 are integrally formed, for example, by casting.

The movable scroll 16 is rotatably supported by the eccentric shaft 14 such that the shaft 14 rotates relative to the movable scroll 16. In other words, the movable scroll 16 is supported by one end of the drive shaft 13 through the eccentric shaft 14. A well known rotation control mechanism 17, which includes a crank pin 17*a,* is provided between the movable scroll 16 and the front housing 11. The control mechanism 17 prevents the movable scroll 16 from rotating about its axis H. Accordingly, when the drive shaft 13 rotates, the movable scroll 16 orbits the axis L of the drive shaft 13.

The fixed scroll 12 includes a base plate 21, which also serves as a housing of the pump, and a volute portion 22 projecting from the inner surface of the base plate 21 towards the front housing 11. The movable scroll 16 includes a base plate 23 and a volute portion 24 projecting from one surface of the base plate 23 towards the fixed scroll 12. The volute portions 22, 24 of both scrolls 12, 16 cooperate with each other. Compression chambers 25, or fluid pockets, are formed by the volute portions 22, 24 and the base plate 21, 23. Volute-shaped seals 31 are attached to ends 22*a,* 24*a* of the volute portions 22, 24. The seal 31 attached to the fixed scroll 12 contacts the surface of the base plate 23 of the movable scroll 16. The seal 31 attached to the movable scroll 16 contacts the surface of the base plate 21 of the fixed scroll 12. The seals 31 seal the compression chambers 25. When the movable scroll 16 orbits the axis L of the drive shaft 13, gas in each compression chamber 25 moves from the periphery of the volute portions 22, 24 to the center, while its volume is reduced.

A peripheral wall 26, which also serves as the pump's housing, is formed integrally on the periphery of the base plate 21 of the fixed scroll 12 to surround the volute portions 22, 24. The peripheral wall 26 has an end surface 26*a* that faces the base plate 23 of the movable scroll 16. A space 27 for accommodating the volute portions 22, 24 is formed between the base plate 21, 23 and within the peripheral wall 26. A dust seal 32 is attached to the end surface 26*a* to contact the base plate 23 of the movable scroll 16 and seal the space 27.

An inlet 28, which is connected to an air intake piping (not shown), is formed in the peripheral wall 26 and is connected to the compression chamber 25 through the accommodation space 27. A discharge passage 29 is formed in the fixed scroll 12 and the movable scroll 16. The discharge passage 29 includes a first passage 29*a* formed in the fixed scroll 12 and a second passage 29*b* formed in the movable scroll 16. The first passage 29*a* is connected to a discharge piping (not shown). The second passage 29*b* is selectively connected or disconnected to the first passage 29*a* when the movable scroll 16 orbits. When the second passage 29*b* is connected to the first passage 29*a,* the compression chamber 25, which is located near the center of the volute portions 22, 24, is connected to the discharge piping through the discharge passage 29. Accordingly, when the movable scroll 16 orbits, the gas drawn into the compression chamber 25 from the intake piping through the inlet 28 is compressed and then discharged from the compression chamber 25 to the discharge piping through the discharge passage 29.

A structure for supporting the movable scroll 16 will now be described referring to FIGS. 1 to 3. A first boss 36 projects from the center of the base plate 23 of the movable scroll 16 in the same direction that the volute portion 24 project. An end surface 36*a* of the first boss 36 and the end surface 24*a* of the volute portion 24 are substantially on the same plane. The second boss 37 projects from the center of the base plate 23 in the opposite direction from the first boss 36.

An eccentric shaft 14 extends from the second boss 37 to the first boss 36. In this case, an end surface 14*a* of the eccentric shaft 14 is substantially on the same plane as the end surface 24*a* of the volute portion 24. Accordingly, a distal section of the eccentric shaft 14 is located in a working region R, which includes the volute portion 24 of the movable scroll 16. That is, part of the eccentric shaft 14 is radially aligned with the compression chamber 25.

A first bearing 35 is located between the inner surface of the first boss 36 and the outer surface of a disal section of the eccentric shaft 14. The eccentric shaft 14 supports the movable scroll 16 through the first bearing 35 in the working region R including the volute portion 24. The first bearing 35 is, for example, a sleeve bearing, and the end surface of the bearing 35 is substantially flush with the end surfaces 36*a,* 14*a* of the first boss 36 and the eccentric shaft 14. A second bearing 34, which is, for example, a roller bearing, is located between the inner surface of the second boss 37 and a proximal section of the eccentric shaft 14. The eccentric shaft 14 supports the movable scroll 16 outside the working region R through the second bearing 34. Accordingly, the eccentric shaft 14 supports the movable scroll 16 both in the region R and outside the region R. The bearings 34, 35 facilitate the rotation of the movable scroll 16 with respect to the eccentric shaft 14 and the orbital movement of the movable scroll 16 about the axis L of the drive shaft 13.

Centrifugal force is applied to the movable scroll 16 when it orbits. Also, a compression reaction force generated by the compression of gas in the compression chamber 25 is applied to the movable scroll 16. The resultant radial working force K based on the centrifugal force and the compression reaction force is highest in the working region R. The force K is received by the eccentric shaft 14 through the first and second bearings 35, 34. The first bearing 35 is located in the region R, where the force K is mainly applied. As a result, the force K is radially received by the eccentric shaft 14. Accordingly, no inclination moment is applied to the movable scroll 16, and the movable scroll 16 does not incline with respect to the fixed scroll 12. This facilitates the orbital movement of the movable scroll 16 and limits gas leakage from the accommodation chamber 27 and the compression chamber 25.

Figure 3:
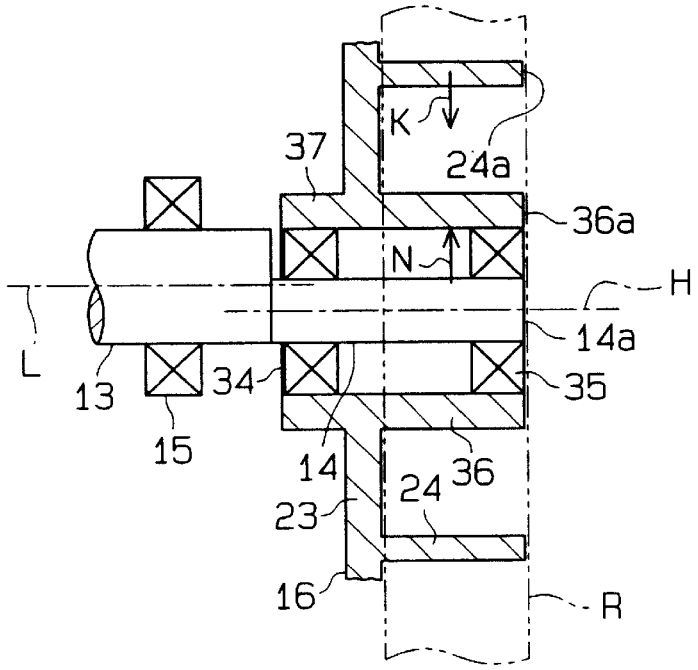
FIG. 3 is a diagrammatic view showing the structure for supporting a movable scroll according to the embodiment of FIG. 1.

FIG. 3 shows a simplified diagram representing the support structure of FIG. 1. The bearings 34, 35 are located at axially spaced-apart locations. A radial supporting force (not shown) is applied to the movable scroll 16 at each spaced-apart location. A resultant N of the supporting forces is shown oppositely directed with respect to the resultant radial working force K. Note that the resultant supporting force N is located in the same radial plane as the radial working force K. The locations of the bearings 34, 35 are selected such that these forces N, K are radially aligned, which prevents an inclining moment from being applied to the movable scroll 16.

The end surfaces 36*a*, 14*a* of the first boss 36 and the eccentric shaft 14 are substantially flush with the end surface 24*a* of the volute portion 24 of the movable scroll 16, and the end surface of the first bearing 35 is substantially flush with the boss and the shaft end surfaces 36*a*, 14*a*. In other words, the first bearing 35 extends axially to reach the outer-most end of the region R. This completely prevents an inclination moment from acting on the movable scroll 16.

If the boss 36 and the eccentric shaft 14 extend axially beyond the region R, it becomes necessary to form a recess for accommodating the distal ends of the boss 36 and the eccentric shaft 14 in the base plate 21 of the fixed scroll 12. However, in the embodiment of FIG. 1, there is no need for this, thus facilitating the manufacture of the fixed scroll 12.

Figure 7:
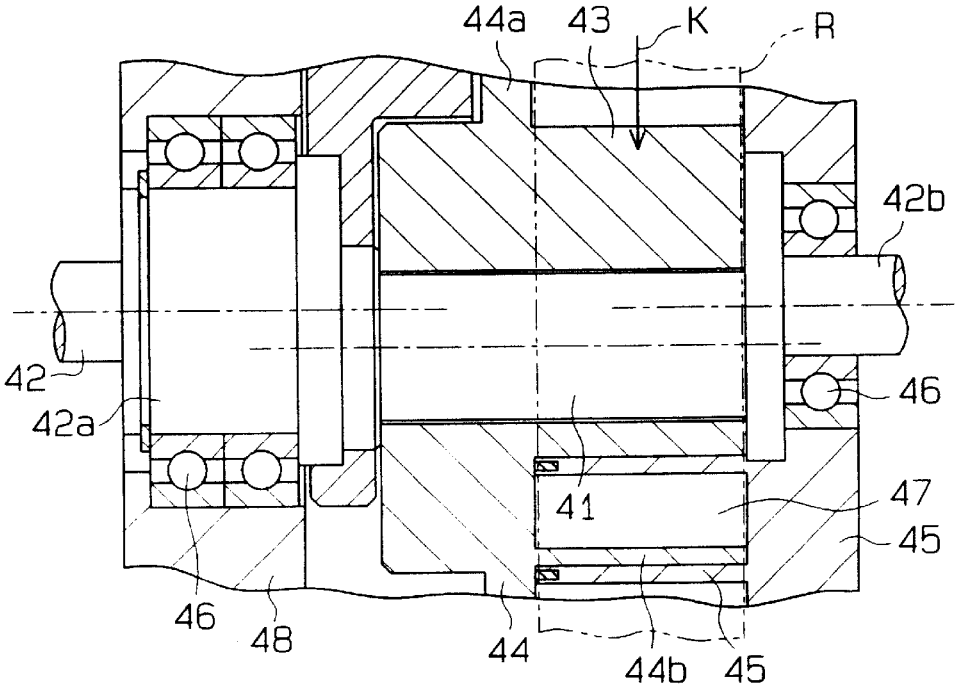
Fig.7(Prior Art)
FIG. 7 is a partial, diagrammatic sectional view showing a further prior art structure for supporting a movable scroll disclosed in Japanese Examined publication No. 63-59032.

The drive shaft 13 is supported by the front housing 11 in one side of the movable scroll 16. Accordingly, there is no need to align axes of portions 42*a*, 42*b* of a drive shaft 42 with high precision as in the prior art embodiment of FIG. 7. Further, even though the drive shaft 13 is integrally formed with the eccentric shaft 14, it is possible to insert the eccentric shaft 14 in the bosses 36, 37. This facilitates machining the parts including the drive shaft 13 and reduces the number of parts, thus facilitating the assembly of parts. As explained, FIG. 1 shows a low-cost pump having a simple structure that is easily manufactured.

The first bearing 35 and the second bearing 34 are axially spaced apart. The eccentric shaft 14 supports the movable scroll 16 at sections radially aligned with the bearings 35, 34, and the movable scroll 16 is not supported between the bearings 35, 34. This is because it is possible for the eccentric shaft 14 to stably support the movable scroll 16 at the bearings 35, 34 only. Accordingly, it is not necessary to support the movable scroll 16 with large first and second bearings that extend over the whole length of the axis H of the eccentric shaft 14. This simplifies and reduces the weight of the construction for supporting the movable scroll 16.

The sections including the bosses 36, 37, supported by the eccentric shaft 14 have the same lengths. Further, the first and second bearings 35, 34 are arranged at the very ends of the sections supported by the eccentric shaft 14 to make the distance in between as wide as possible. This enables the eccentric shaft 14 to support the movable scroll 16 more stably.

The second bearing 34 is larger than the first bearing 35. In other words, the load applied to the first bearing 35, which is located in the working region R, is more widely distribution by supporting the movable scroll 16 with the relatively large second bearing 34. Therefore, the first bearing 35 is compact. The compact first bearing 35 makes it possible to miniaturize the first boss 36 for accommodating the bearing 35. When the first boss 36 is small, the volute portions 22, 24 can be extended to the vicinity of the center of the scrolls 12, 16. This improves gas compression without increasing the size of the pump.

Figure 4:
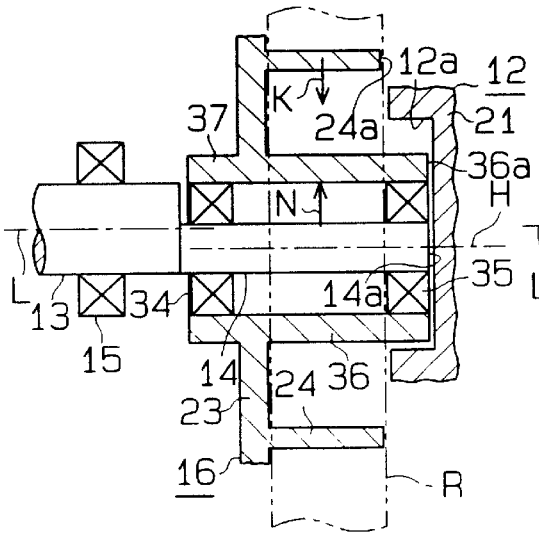
FIG. 4 is a partial, diagrammatic sectional view showing a structure for supporting a movable scroll in a second embodiment of the present invention.

FIG. 4 shows a second embodiment of the present invention. In this embodiment, the first boss 36 and the eccentric shaft 14 extend axially beyond the end surface 24*a* of the volute portion 24, that is, beyond the working region R. Accordingly, the first and second bearings 35, 34 straddle the region R. A recess 12*a* for accommodating the distal ends of the first boss 36 and the eccentric shaft 14 is formed in the inner surface of the base plate 21 of the fixed scroll 12. The structure of this embodiment provides more stable support for the movable scroll 16.

Figure 5:
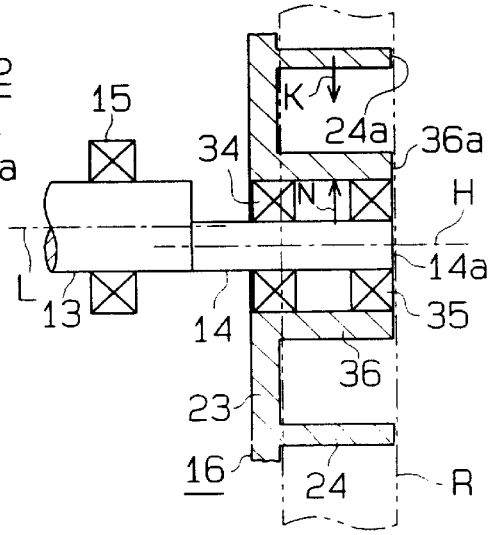
FIG. 5 is a partial, diagrammatic sectional view showing a structure for supporting a movable scroll in a third embodiment of the present invention.
Figure 6:
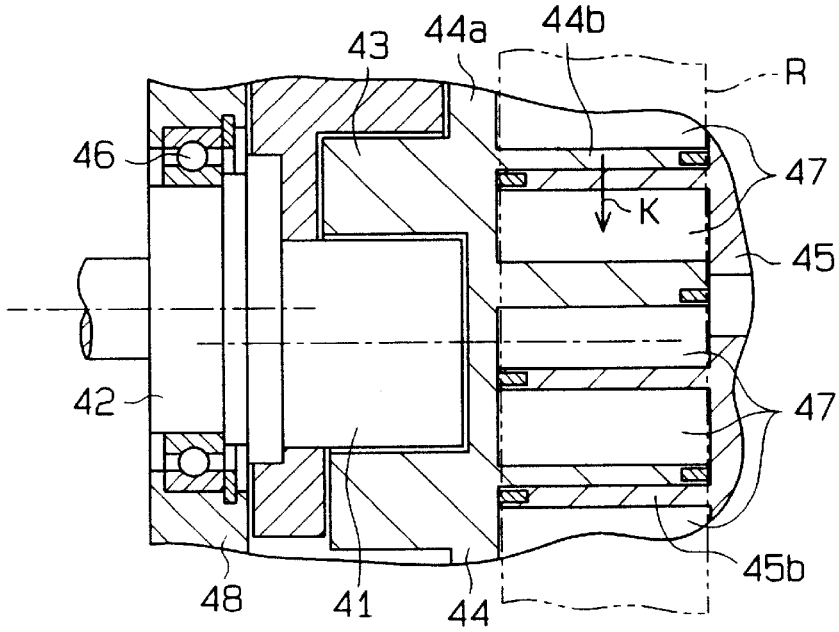
Fig.6(Prior Art)
FIG. 6 is a partial, diagrammatic sectional view showing a prior art structure for supporting a movable scroll from Japanese Examined publication No. 63-59032.

FIG. 5 shows a third embodiment of the present invention. In this embodiment, the second boss 37 of FIG. 1 is omitted. As a result, a part of the second bearing 34 is located in the working region R.

In the embodiments of FIG. 1 to FIG. 5, the bearings 34, 35 may be omitted, and the movable scroll 16 may be directly supported by the eccentric shaft 14. In this case, a coating, mainly made of polytetrafluoroethylene, is preferably applied to at least one of the outer surfaces of the eccentric shaft 14 and the inner surface of the movable scroll 16, or lubricant may be applied in between. In this way, the sliding resistance between the eccentric shaft 14 and the movable scroll 16 becomes small, and frictional wear is prevented, achieving smooth motion of the movable scroll 16.

The present invention is not limited to a vacuum pump and may be applied to a scroll-type compressors applied to air conditioning systems.

Therefore, the present examples and embodiments are to be considered as illustrative and not restrictive and the invention is not to be limited to the details given herein, but may be modified within the scope and equivalence of the appended claims.

What is claimed is:

1. A scroll-type fluid mover comprising:

a fixed scroll, which includes a base plate and a volute portion extending from the base plate;

a movable scroll, which includes a base plate having a first surface from which a volute portion extends and a second surface opposite to the first surface, the movable scroll includes a first boss projecting from the first surface and a second boss projecting from the second surface, wherein the two volute portions cooperate to form a variable displacement fluid pocket between the two scrolls;

a drive shaft, which is driven to rotate about its axis;

a eccentric shaft connected to the drive shaft, the axis of the eccentric shaft being offset from the axis of the drive shaft, wherein the eccentric shaft has a proximal end and a distal end, the proximity end being fixed to the drive shaft and the distal end being radially unsupported, and wherein the eccentric shaft supports the movable scroll at a plurality of axially spaced-apart supports locations, the first and second bosses surround the eccentric shaft, and the eccentric shaft rotatably supports the movable scroll through the first and second bosses;

a first bearing located between the eccentric shaft and the first boss;

a second bearing, axially spaced apart from the first bearing, located between the eccentric shaft and the second boss, wherein the first and second bearings are located at the axially spaced-apart support locations; and a rotation control mechanism engaged with the movable scroll for allowing the movable scroll to orbit the axis of the drive shaft without rotating about its own axis when the drive shaft rotates, and wherein gas is introduced into and compressed in the fluid pocket in accordance with the orbital movement of the movable scroll, and further wherein the volute portion of the movable scroll has an end surface facing the base plate of the fixed scroll, the eccentric shaft, the first boss, and the first bearing respectively extending axially at least as far as the end surface of the volute portion, whereby the eccentric shaft supports the movable scroll to prevent inclination of the movable scroll with respect to the fixed scroll.

2. The scroll-type fluid mover of claim 1, wherein at least one of the spaced-apart support locations is radially aligned with the volute portion of the movable scroll.

3. The scroll-type fluid mover of claim 1, wherein the spaced-apart support locations are at opposite ends of the eccentric shaft.

4. The scroll-type fluid mover of claim 1, wherein the second bearing is larger than the first bearing.

5. The scroll-type fluid mover of claim 1, wherein the end surfaces of the eccentric shaft, the first boss, and the first bearing are substantially flush with the end surface of the volute portion.

6. The scroll-type fluid mover of claim 1, wherein the eccentric shaft is integrally formed on the drive shaft.

7. The scroll-type fluid mover of claim 1 further including a housing for accommodating the movable scroll, the housing including a first housing member rotatably supporting the drive shaft and a second housing member connected to the first housing member and serving also as the fixed scroll.

8. A scroll-type fluid mover comprising:

a fixed scroll serving as part of a housing, the fixed scroll including a base plate and a volute portion formed on the base plate;

a movable scroll accommodated in the housing, wherein the movable scroll includes a base plate having first and second surfaces and a volute portion of formed on the first surface, and wherein the two volute portions cooperate to form a variable displacement fluid pocket between the two scrolls;

a first boss projecting axially from the first surface and a second boss projecting axially from the second surface, wherein the first boss is axially located in a location that is radially aligned with the volute portion of the movable scroll, and the second boss is axially located out of radial alignment with the volute portion of the movable scroll;

a drive shaft rotatably supported in the housing;

an eccentric shaft formed integrally on one end of the drive shaft, the axis of the eccentric shaft being offset from the axis of the drive shaft, wherein the eccentric shaft has a proximal end and a distal end, the proximal end being fixed to the drive shaft and the distal end being radially unsupported, and wherein the eccentric shaft rotatably supports both bosses to support the movable scroll;

a first bearing located between the eccentric shaft and the first boss and a second bearing, axially spaced apart from the first bearing, located between the eccentric shaft and the second boss, wherein the eccentric shaft radially supports the movable scroll at the axial locations of the bearings, and wherein the volute portion of the movable scroll has an end surface facing the base plate of fixed scroll, the distal end surfaces of the eccentric shaft and the first boss are substantially flush with the end surface of the volute portion, and the end surface of the first bearing is substantially flush with the distal end surfaces of the eccentric shaft and the first boss; and a rotation control mechanism engaged with the movable scroll for allowing the movable scroll to orbit the axis of the drive shaft without rotating about its own axis when the drive shaft rotates, wherein gas is introduced into and compressed in the fluid pocket in accordance with the orbital movement of the movable scroll, and wherein the eccentric shaft receives a radial working force mainly through the first boss, wherein the radial working force is mainly produced in the volute portion of the movable scroll.

9. The scroll-type fluid mover of claim 8, wherein the second bearing is larger than the first bearing.

* * * * *

UNITED STATES PATENT AND TRADEMARK OFFICE

CERTIFICATE OF CORRECTION

PATENT NO. : 6,213,742 B1
DATED : April 10, 2001
INVENTOR(S) : Ishikawa et al.

It is certified that error appears in the above-identified patent and that said Letters Patent is hereby corrected as shown below:

Column 4,
Line 37, "portion 24 project." should read -- portion 24 projects --

Column 6,
Line 9-10, "widely distribution" should read -- widely distributed --

Column 7,
Line 1, "proximity" should read -- proximal --

Signed and Sealed this

Fifth Day of March, 2002

*Attest:*

*Attesting Officer*

JAMES E. ROGAN
*Director of the United States Patent and Trademark Office*